US009809884B2

(12) United States Patent
Hoshino et al.

(10) Patent No.: US 9,809,884 B2
(45) Date of Patent: Nov. 7, 2017

(54) METHOD FOR MANUFACTURING GALVANIZED STEEL SHEET

(71) Applicant: JFE STEEL CORPORATION, Tokyo (JP)

(72) Inventors: Katsuya Hoshino, Fukuyama (JP); Shoichiro Taira, Tokyo (JP); Wataru Tanimoto, Fukuyama (JP); Masayasu Nagoshi, Kawasaki (JP)

(73) Assignee: JFE STEEL CORPORATION, Tokyo (JP)

( * ) Notice: Subject to any disclaimer, the term of this patent is extended or adjusted under 35 U.S.C. 154(b) by 290 days.

(21) Appl. No.: 14/761,133

(22) PCT Filed: Jan. 14, 2014

(86) PCT No.: PCT/JP2014/000104
§ 371 (c)(1),
(2) Date: Jul. 15, 2015

(87) PCT Pub. No.: WO2014/112347
PCT Pub. Date: Jul. 24, 2014

(65) Prior Publication Data

US 2016/0024660 A1 Jan. 28, 2016

(30) Foreign Application Priority Data

Jan. 16, 2013 (JP) ..... 2013-005389

(51) Int. Cl.
*C23C 8/80* (2006.01)
*B08B 3/08* (2006.01)
(Continued)

(52) U.S. Cl.
CPC ..... *C23C 22/07* (2013.01); *C23C 2/06* (2013.01); *C23C 2/26* (2013.01); *C23C 22/53* (2013.01);
(Continued)

(58) Field of Classification Search
CPC ..... C23C 8/80; C23C 22/60; B08B 3/08
See application file for complete search history.

(56) References Cited

U.S. PATENT DOCUMENTS 6,861,160 B2 3/2005 Ando
2007/0003706 A1 1/2007 Taira
(Continued)

FOREIGN PATENT DOCUMENTS

CA 2470042 2/2005
CN 1423708 6/2003
(Continued)

OTHER PUBLICATIONS

Chinese Office Action dated Jun. 2, 2016 for Chinese Application No. 201480004652.0, including Concise Statement of Relevance, 14 pages.
(Continued)

*Primary Examiner* — Lois Zheng
(74) *Attorney, Agent, or Firm* — RatnerPrestia

(57) ABSTRACT

There is provided a method for manufacturing a galvanized steel sheet that has low sliding resistance in press forming and good degreasing property even under severe alkaline degreasing treatment conditions due to low temperature and short process line length. An oxide layer formed on the surface of a galvanized steel sheet is subjected to neutralization treatment using an alkaline aqueous solution containing 0.01 g/L or more of P ions and 0.01 g/L or more of colloid dispersed particles, wherein the alkaline aqueous solution preferably contains at least one phosphorus compound selected from phosphates, pyrophosphates, and triphosphates and at least one type of colloid dispersed particles selected from Ti, silica, Pt, Pd, Zr, Ag, Cu, Au, and Mg.

11 Claims, 1 Drawing Sheet

(51) Int. Cl.

| | |
|---|---|
| ***C23C 22/60*** | (2006.01) |
| ***C23C 22/07*** | (2006.01) |
| ***C23C 22/83*** | (2006.01) |
| ***C23C 22/53*** | (2006.01) |
| ***C23C 2/06*** | (2006.01) |
| ***C23C 2/26*** | (2006.01) |
| ***C23C 22/78*** | (2006.01) |
| ***C23C 28/00*** | (2006.01) |

(52) U.S. Cl.
CPC ..... *C23C 22/60* (2013.01); *C23C 22/78* (2013.01); *C23C 22/83* (2013.01); *C23C 28/321* (2013.01); *C23C 28/345* (2013.01)

(56) References Cited

U.S. PATENT DOCUMENTS

| | | | | |
|---|---|---|---|---|
| 2009/0283110 | A1* | 11/2009 | Yoneda | C23G 1/02 134/2 |
| 2013/0086960 | A1 | 4/2013 | Hoshino | |

FOREIGN PATENT DOCUMENTS

| | | | |
|---|---|---|---|
| CN | 1598058 | | 3/2005 |
| CN | 100462481 | | 2/2009 |
| CN | 101374974 | | 2/2009 |
| EP | 1288325 | | 3/2003 |
| EP | 1348780 | | 10/2003 |
| EP | 1959032 | | 8/2008 |
| EP | 2182091 | A1 | 5/2010 |
| JP | 03191093 | | 8/1991 |
| JP | 2002256448 | | 9/2002 |
| JP | 2003306781 | | 10/2003 |
| JP | 2006183074 | | 7/2006 |
| JP | 2006183074 | A | 7/2006 |
| JP | 2007016266 | | 1/2007 |
| JP | 2007016267 | | 1/2007 |
| KR | 20030077545 | | 10/2003 |
| RU | 2431697 | C1 | 10/2011 |
| WO | 2011121910 | | 10/2011 |

OTHER PUBLICATIONS

Korean Office Action dated May 13, 2016 for Korean Application No. 2015-7019060, including Concise Statement of Relevance, 12 pages.
Extended European Search Report for European Application No. 14740381.0-1362 dated Dec. 22, 2015.
Russian Office Action with English language translation for Application No. 2015134186, dated Mar. 14, 2017, 13 pages.
International Search Report for International Application No. PCT/JP2014/000104 dated Feb. 10, 2014.

* cited by examiner

METHOD FOR MANUFACTURING GALVANIZED STEEL SHEET

CROSS REFERENCE TO RELATED APPLICATIONS

This is the U.S. National Phase application of PCT/JP2014/000104, filed Jan. 14, 2014, which claims priority to Japanese Patent Application No. 2013-005389, filed Jan. 16, 2013, the disclosures of each of these applications being incorporated herein by reference in their entireties for all purposes.

FIELD OF THE INVENTION

Aspects of the present invention relate to a method for manufacturing a galvanized steel sheet that has good sliding characteristics in press forming and good alkaline degreasing property in an automobile manufacturing process.

BACKGROUND OF THE INVENTION

Galvanized steel sheets are used in a wide variety of fields, typically in automotive body applications. Galvanized steel sheets in automotive body applications are subjected to press forming and painting before use.

However, one drawback of galvanized steel sheets is that they have lower press formability than cold-rolled steel sheets. This is because galvanized steel sheets have higher sliding resistance on press dies than cold-rolled steel sheets. More specifically, high sliding resistance between a press die and a bead often hampers a galvanized steel sheet from entering the press die, thus causing the galvanized steel sheet to fracture.

A method of applying a high-viscosity lubricating oil is widely used as a method for improving press formability of galvanized steel sheet during use. In this method, however, running out of oil in press forming results in unstable press performance. Thus, galvanized steel sheets are strongly required to have improved press formability by themselves.

In recent years, attempts have been made to simplify manufacturing processes and reduce environmentally-hazardous substances in manufacturing processes. In particular, in an alkaline degreasing process, which is a pretreatment process before a painting process, progress is being made in decreasing the process line length and the temperature of the work environment. Thus, there is a demand for galvanized steel sheets having good degreasing property without adversely affecting the painting process even under such severe conditions.

Thus, there is a demand for a galvanized steel sheet for use in automobiles that has good press formability and good degreasing property even under severer alkaline degreasing treatment conditions than before.

A technique for improving press formability may be a technique of forming a lubricating film on the surface of galvanized steel sheet or a technique of forming an oxide layer on the surface of galvanized steel sheet.

Patent Literature 1 discloses a technique for improving press formability and chemical conversion treatability by producing Ni oxides on the surface of galvanized steel sheet by electrolysis treatment, dip treatment, painting oxidation treatment, or heat treatment.

Patent Literatures 2 and 3 disclose a technique for improving sliding characteristics by bringing a galvannealed steel sheet into contact with an acidic solution to form an oxide layer composed mainly of Zn oxides on the surface of galvannealed steel sheet, thereby suppressing adhesion between the galvannealed layer and a press die.

A technique for improving degreasing property may be a technique of washing a galvannealed steel sheet with an alkaline solution or a solution containing phosphorus (P).

Patent Literature 4 describes a technique for improving degreasing property by washing the surface of galvannealed steel sheet with an alkaline solution.

Patent Literature 5 describes a technique for improving degreasing property by washing the surface of galvannealed steel sheet with a solution containing P.

PATENT LITERATURE

PTL 1: Japanese Unexamined Patent Application Publication No. 03-191093

PTL 2: Japanese Unexamined Patent Application Publication No. 2002-256448

PTL 3: Japanese Unexamined Patent Application Publication No. 2003-306781

PTL 4: Japanese Unexamined Patent Application Publication No. 2007-016266

PTL 5: Japanese Unexamined Patent Application Publication No. 2007-016267

SUMMARY OF THE INVENTION

In Patent Literatures 1 to 3, lubricity between a press die and a galvanized steel sheet results from the lubrication effect of a lubricant or a surface reaction layer (oxide layer). However, the degreasing property in the techniques described in Patent Literatures 1 to 3 does not satisfy required characteristics. With respect to the techniques described in Patent Literatures 4 and 5, although the effect of improving degreasing property can be observed, the effect does not satisfy required characteristics.

In view of such situations, it is desirable to provide a method for manufacturing a galvanized steel sheet having good degreasing property and low sliding resistance in press forming even under severe alkaline degreasing treatment conditions due to low temperature and short process line length.

The present inventors discovered that the problems described above can be solved by neutralization treatment of an oxide layer formed on the surface of galvanized steel sheet using an alkaline aqueous solution containing 0.01 g/L or more of P ions and 0.01 g/L or more of colloid dispersed particles. For example, exemplary embodiments of the present invention provide the following:

(1) A method for manufacturing a galvanized steel sheet that includes an oxide layer on the surface thereof, characterized by including;

an oxide layer forming step of bringing a galvanized steel sheet into contact with an acidic solution for 1 to 60 seconds, and then washing the galvanized steel sheet with water, and a neutralization treatment step of bringing the surface of the oxide layer formed in the oxide layer forming step into contact with an alkaline aqueous solution for 0.5 seconds or more, washing the surface of the oxide layer with water, and drying the surface of the oxide layer, wherein the alkaline aqueous solution contains 0.01 g/L or more of P ions and 0.01 g/L or more of colloid dispersed particles.

(2) The method for manufacturing a galvanized steel sheet according to (1), characterized in that the alkaline aqueous solution contains at least one phosphorus compound selected from phosphates, pyrophosphates, and triphosphates and at least one type of colloid dispersed particles selected from Ti, silica, Pt, Pd, Zr, Ag, Cu, Au, and Mg.

(3) The method for manufacturing a galvanized steel sheet according to (1) or (2), characterized in that the alkaline aqueous solution has a pH in the range of 9 to 12 and a temperature in the range of 20° C. to 70° C.

(4) The method for manufacturing a galvanized steel sheet according to any one of (1) to (3), characterized in that the acidic solution has a pH buffering action and a degree of pH increase in the range of 0.05 to 0.5, the degree of pH increase being the amount (L) of 1.0 mol/L sodium hydroxide solution to increase the pH of 1 L of the acidic solution to 2.0 to 5.0.

(5) The method for manufacturing a galvanized steel sheet according to any one of (1) to (4), characterized in that the acidic solution contains 5 to 50 g/L in total of at least one salt selected from acetates, phthalates, citrates, succinates, lactates, tartrates, borates, and phosphates, has a pH in the range of 0.5 to 5.0, and a temperature in the range of 20° C. to 70° C.

(6) The method for manufacturing a galvanized steel sheet according to any one of (1) to (5), characterized in that the amount of acidic solution deposited on the surface of galvanized steel sheet after contact with the acidic solution in the oxide forming step is 15 $g/m^2$ or less.

(7) The method for manufacturing a galvanized steel sheet according to any one of (1) to (6), characterized in that the galvanized steel sheet is a galvannealed steel sheet.

(8) The method for manufacturing a galvanized steel sheet according to any one of (1) to (6), characterized in that the galvanized steel sheet is a hot-dipped galvanized steel sheet.

(9) The method for manufacturing a galvanized steel sheet according to any one of (1) to (6), characterized in that the galvanized steel sheet is an electrogalvanized steel sheet.

(10) The method for manufacturing a galvanized steel sheet according to any one of (1) to (9), characterized in that the galvanized steel sheet is subjected to skin pass rolling before the oxide layer forming step.

(11) The method for manufacturing a galvanized steel sheet according to any one of (1) to (10), characterized in that the galvanized steel sheet is brought into contact with an alkaline aqueous solution to activate the surface thereof before the oxide layer forming step.

Aspects of the present invention provide a galvanized steel sheet that has low sliding resistance in press forming and good degreasing property even under severe alkaline degreasing treatment conditions due to low temperature and short process line length.

DETAILED DESCRIPTION OF EMBODIMENTS OF THE INVENTION

Figure 1:
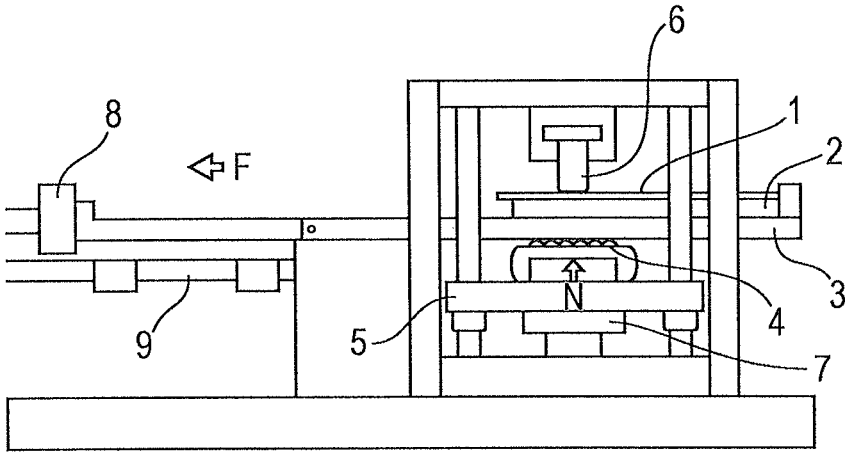
FIG. 1 is a schematic front view of a friction coefficient measuring apparatus.

Embodiments of the present invention will be described below. The present invention is not limited to these embodiments.

A method for manufacturing a galvanized steel sheet includes an oxide layer on the surface thereof. For example, a method for manufacturing a galvanized steel sheet according to aspects of the present invention includes a galvanization step, an oxide layer forming step, and a neutralization treatment step. Each of the steps will be described below.

First, an exemplary galvanization step will be described below. In the galvanization step, any galvanization method, including a general method, such as hot-dipped galvanizing or electrogalvanizing, may be used. The electrogalvanizing or hot-dipped galvanizing treatment conditions are not particularly limited and may be any preferred conditions. In hot-dipped galvanizing treatment, the addition of Al to a galvanizing bath is preferred as a measure to decrease dross. In this case, additive elements other than Al are not particularly limited. More specifically, use of a galvanizing bath that contains minute amounts of Pb, Sb, Si, Sn, Mg, Mn, Ni, Ti, Li, and/or Cu in addition to Al does not reduce the advantages offered by embodiments of the present invention.

Furthermore, in the galvanization step, alloying treatment may be performed after hot-dipped galvanizing. The alloying treatment conditions are not particularly limited and may be any preferred conditions.

The type of a base steel sheet subjected to galvanizing treatment or a base steel sheet subjected to galvanizing treatment and alloying treatment is not particularly limited and may be a low-carbon steel sheet, an ultra-low carbon steel sheet, an IF steel sheet, or a high-strength steel sheet to which alloying elements are added. A hot-rolled steel sheet or a cold-rolled steel sheet may be used as a base steel sheet.

When a galvanized steel sheet is a galvannealed steel sheet, it is desirable that the area fraction of flat portions (top surfaces of raised portions of asperities) on the surface of the galvannealed layer ranges from 20% to 80%. When the area fraction is less than 20%, the contact area between portions (recessed portions) other than the flat portions and a press die increases, and the area fraction of the flat portions with which the thickness of an oxide layer described below can be properly controlled decreases relative to the actual area in contact with the press die. This reduces the effect of improving press formability. The portions other than the flat portions can retain press oil during press forming. Thus, when the area fraction of the flat portions exceeds 80%, this tends to result in running out of oil during press forming of galvannealed steel sheet, thus reducing the effect of improving press formability.

Flat portions on the surface of galvannealed layer can be easily identified by observation with an optical microscope or a scanning electron microscope. The area fraction of flat portions on the surface of galvannealed layer can be determined by image analysis of a photomicrograph.

Skin pass rolling may be performed after the galvanization step and before the oxide layer forming step. Planarization due to skin pass rolling on the surface of galvanized steel sheet can reduce surface asperities. This can decrease the force required to flatten raised portions on the surface of galvanized layer with a press die in press forming, thereby improving sliding characteristics.

In particular, owing to a difference in reactivity at the interface between the galvannealed steel sheet and the galvannealed layer in alloying treatment, the surface of galvannealed steel sheet has asperities. Skin pass rolling of a galvannealed steel sheet is desirable in order to significantly improve sliding characteristics between the galvannealed steel sheet and a press die.

Furthermore, activation treatment using an alkaline aqueous solution may be performed after the galvanizing treatment. In particular, traditional hot-dipped galvanized steel sheets and electrogalvanized steel sheets have an oxide layer having a thickness of less than 10 nm and containing Zn and impurity elements like Al. Removal of such an oxide layer using an alkaline aqueous solution can promote a reaction in the subsequent oxide layer forming step, thereby reducing the manufacturing time. The alkaline aqueous solution for use in the activation treatment preferably has a pH in the range of 10 to 14. A pH of less than 10 may result in incomplete removal of the oxide layer. A pH of more than 14 may result in strong dissolution of the galvanized layer, darkening of the surface, and a state called burn. It is desirable that the alkaline aqueous solution have a temperature in the range of 20° C. to 70° C. The alkaline aqueous solution may contain any alkali, preferably a chemical such as NaOH in terms of cost. The alkaline aqueous solution may contain substances and elements other than Zn, Al, Fe, and so on contained in the galvanized layer.

The subsequent oxide layer forming step is a step of bringing the surface of galvanized steel sheet into contact with an acidic solution for 1 to 60 seconds, and then washing the galvanized steel sheet with water.

The mechanism of the formation of oxide layer in this step is not clear but may be as described below. Upon contact between the galvanized steel sheet and the acidic solution, zinc of the galvanized steel sheet is dissolved in the acidic solution. The dissolution of zinc is accompanied by a hydrogen generation reaction. Thus, as the dissolution of zinc proceeds, the hydrogen-ion concentration of the acidic solution decreases, the pH of the acidic solution increases, and an oxide layer composed mainly of Zn is formed on the surface of galvanized steel sheet. The oxide layer may contain metal oxides and/or other elements in addition to Zn. Owing to impurities in the acidic solution, the oxide layer may contain S, N, P, B, Cl, Na, Mn, Ca, Mg, Ba, Sr, and/or Si.

The surface of galvanized steel sheet in contact with a press die in press forming is preferably composed of a hard and high melting point substance in order to prevent adhesion to the press die and improve sliding characteristics. The oxide layer formed in the oxide layer forming step is hard and has a high melting point. Thus, the oxide layer can prevent adhesion to a press die and effectively improve sliding characteristics. In particular, when a surface flat portion of the galvanized steel sheet subjected to skin pass rolling is subjected to a treatment that uniformly forms an oxide layer, the galvanized steel sheet can have good and stable sliding characteristics.

The oxide layer is worn away by contact with a press die during press forming. Thus, the oxide layer should have a sufficient thickness so as not to reduce the provided advantages. The required thickness depends on the degree of forming in press forming. For example, forming involving large deformation or forming with a large contact area between a press die and the oxide layer warrants the oxide layer having a greater thickness. The oxide layer may have a thickness in the range of 10 to 200 nm. The galvanized steel sheet that includes an oxide layer having an average thickness of 10 nm or more can have good sliding characteristics. In particular, the oxide layer having a thickness of 20 nm or more is more effective. This is because even when the surface oxide layer is worn away by press forming with a large contact area between a press die and a workpiece (galvanized steel sheet), a remaining oxide layer can suppress degradation of sliding characteristics. Although the thickness of the oxide layer does not have a particular upper limit, a thickness of more than 200 nm may result in excessively low surface reactivity, making the formation of a chemical conversion film difficult. Thus, it is desirable that the oxide layer have an average thickness of 200 nm or less. The thickness of the oxide layer can be controlled by changing the conditions for the formation of the oxide layer described below.

More specifically, the oxide layer forming step can be performed by bringing a galvanized steel sheet into contact with an acidic solution for a predetermined time, washing the galvanized steel sheet with water, and drying the galvanized steel sheet. Specific materials that may be used and manufacturing conditions are described below.

The acidic solution used in the oxide layer forming step may have any pH that allows zinc to be dissolved and an oxide layer to be formed. Among acidic solutions, acidic solutions having a pH buffering action are preferably used. Acidic solutions having a pH buffering action are less likely to instantaneously increase the pH of the solutions than acidic solutions having no pH buffering action, thus allowing an oxide layer to be sufficiently formed. When the acidic solution to be used has a pH buffering action, an oxide layer having good sliding characteristics can be stably formed. Thus, even when the acidic solution contains metal ions and/or inorganic compounds as impurities or on purpose, the advantages are rarely lost.

The pH buffering action of the acidic solution can be assessed by the degree of pH increase, which is the amount (L) of 1.0 mol/L aqueous sodium hydroxide to, increase the pH of 1 liter of the acidic solution to 2.0 to 5.0. The degree of pH increase may range from 0.05 to 0.5. When the degree of pH increase is less than 0.05, the pH increases rapidly, and the dissolution of zinc may be insufficient for the formation of an oxide layer. Thus, an insufficient amount of oxide layer is sometimes formed. On the other hand, when the degree of pH increase is more than 0.5, the dissolution of zinc may be excessively promoted, the formation of an oxide layer may require extended periods, or the galvanized layer may be heavily damaged. Thus, the galvanized steel sheet may lose its original function as an anticorrosive steel sheet. The degree of pH increase of an acidic solution having a pH of more than 2.0 is assessed after an inorganic acid having little buffering action at a pH in the range of 2.0 to 5.0, such as sulfuric acid, is added to the acidic solution to temporarily decrease the pH to 2.0.

The acidic solution having such a pH buffering action may be an aqueous solution containing 5 to 50 g/L in total of at least one salt selected from acetates, such as sodium acetate ($CH_3COONa$), phthalates, such as potassium hydrogen phthalate ($(KOOC)_2C_6H_4$), citrates, such as sodium citrate ($Na_3C_6H_5O_7$) and potassium dihydrogen citrate ($KH_2C_6H_5O_7$), succinates, such as sodium succinate ($Na_2C_4H_4O_4$), lactates, such as sodium lactate ($NaCH_3CHOHCO_2$), tartrates, such as sodium tartrate ($Na_2C_4H_4O_6$), borates, and phosphates. At a concentration of less than 5 g/L, the pH of the acidic solution increases relatively rapidly with the dissolution of zinc. Thus, an oxide layer sufficient to improve sliding characteristics may not be formed. At a concentration of more than 50 g/L, the dissolution of zinc may be promoted, and not only may the formation of an oxide layer require extended periods, but also the galvanized layer may be heavily damaged. Thus, the galvanized steel sheet may lose its original function as an anticorrosive steel sheet.

The acidic solution preferably has a pH in the range of 0.5 to 5.0. An excessively low pH of the acidic solution results in faster dissolution of zinc but a smaller amount of oxide layer. Thus, it is desirable that the pH of the acidic solution be 0.5 or more. On the other hand, an excessively high pH results in a low reaction rate of the dissolution of zinc. Thus, it is desirable that the pH of the acidic solution be 5.0 or less.

The acidic solution preferably has a temperature in the range of 20° C. to 70° C. This is because less than 20° C. may result in an oxide layer formation reaction for extended periods and low productivity. On the other hand, when the acidic solution has a temperature of more than 70° C., although the reaction proceeds relatively fast, the surface of galvanized steel sheet may be unevenly treated.

The galvanized steel sheet may be brought into contact with the acidic solution by any method, for example, a method of immersing the galvanized steel sheet in the acidic solution, a method of spraying the galvanized steel sheet with the acidic solution, or a method of applying the acidic solution to the galvanized steel sheet with an application roll. It is desirable that a thin acidic solution film be finally disposed on the surface of galvanized steel sheet. This is because a large amount of acidic solution on the surface of galvanized steel sheet may retard the pH increase of the acidic solution even when zinc is dissolved, possibly causing continuous dissolution of zinc and retarding the formation of an oxide layer. This is also because a large amount of acidic solution on the surface of galvanized steel sheet may result in heavier damage to the galvannealed layer, and the galvannealed steel sheet may lose its original function as an anticorrosive steel sheet. In this respect, it is effective to adjust the amount of acidic solution to be 15 $g/m^2$ or less. The amount of acidic solution can be adjusted with squeeze rolls or by air wiping. The amount of acidic solution can be measured with an infrared moisture meter manufactured by CHINO Corporation.

The contact time with the acidic solution before water washing (holding time before water washing) ranges from 1 to 60 seconds. When the contact time before water washing is less than 1 second, the acidic solution is washed out before an oxide layer composed mainly of Zn is formed due to pH increases of the acidic solution. Thus, the sliding characteristics may not be improved. The amount of oxide layer does not change when the contact time before water washing is more than 60 seconds. The contact is preferably performed in an atmosphere having a higher oxygen content than the air in order to promote oxidation.

Water washing is performed at the end of the oxide layer forming step.

In the subsequent neutralization treatment step, the surface of the oxide layer formed in the oxide layer forming step is brought into contact with an alkaline aqueous solution for 0.5 seconds or more, is washed with water, and is dried.

The contact of the oxide layer with an alkaline aqueous solution containing P ions and colloid dispersed particles can achieve good degreasing property even under severe alkaline degreasing treatment conditions under which the treating time is decreased due to low temperature and short process line length. For example, the low temperature refers to a temperature in the range of 35° C. to 40° C., and the short treating time due to short process line length refers to a treating time in the range of 60 to 90 seconds.

The mechanism of the improvement of degreasing property is not clear but may be as described below. An acidic solution remaining on the oxide layer surface after water washing and drying increases the etching amount of surface, forms microscopic asperities, and increases an affinity for oil. Washing with an alkaline aqueous solution and complete neutralization prevent the acidic solution from remaining on the oxide layer surface. Furthermore, P ions in the alkaline aqueous solution are deposited on the oxide layer surface. P ions, which are used in traditional synthetic detergents, have a detergent action. Thus, P ions on the oxide layer surface can contribute to good degreasing property even under severe alkaline degreasing treatment conditions. A very small amount of colloid dispersed particles that coexist with the P ions in the alkaline aqueous solution can serve as nuclei for deposition of the P ions on the oxide layer surface and allow the P ions to be efficiently and evenly deposited on the oxide layer surface.

The materials used in the neutralization treatment step and the neutralization treatment conditions are described below.

The concentration of P ions in the alkaline aqueous solution should be 0.01 g/L or more in order to obtain the effect described above. The concentration of P ions in the alkaline aqueous solution preferably ranges from 0.1 to 10 g/L. When the concentration of P ions is less than 0.1 g/L, P may be insufficiently deposited on the oxide layer. When the concentration of P ions is more than 10 g/L, the oxide layer may be dissolved.

The P ions in the alkaline solution may be derived from any phosphorus compound. For example, the phosphorus compound is preferably at least one of phosphates, pyrophosphates, and triphosphates in terms of cost and availability.

The colloid dispersed particles are particles that can be dispersed in a colloidal state in the alkaline aqueous solution. The concentration of colloid dispersed particles in the alkaline aqueous solution should be 0.01 g/L or more for the purpose for which the colloid dispersed particles are used. The concentration preferably ranges from 0.01 to 5.00 g/L. Less than 0.01 g/L may result in insufficient nucleation for deposition of P ions, and 5.00 g/L or less is desirable in terms of manufacturing cost.

It is desirable that the colloid dispersed particles have a particle size in the range of 10 nm to 100 μm. 10 nm or more is desirable in terms of manufacturing cost. Particles having a particle size of more than 100 μm may be too large to serve a function of nucleation. The particle size refers to the average particle size. When the particle size of colloid dispersed particles is measured, the particle size measured by a generally accepted method may be used.

The colloid dispersed particles that can preferably be used may be Ti, silica, Pt, Pd, Zr, Ag, Cu, Au, or Mg. These colloid dispersed particles may be used in combination. These colloid dispersed particles are preferably used in terms of cost and availability.

The alkaline aqueous solution may have any pH, provided that the alkaline aqueous solution is alkaline. The pH preferably ranges from 9 to 12. A pH of 9 or more is preferred because neutralization treatment can be sufficiently performed. A pH of 12 or less is preferred because the dissolution of Zn oxides in the oxide layer can be easily prevented.

The alkaline aqueous solution may have any temperature. The solution temperature preferably ranges from 20° C. to 70° C. A solution temperature of 20° C. or more is preferred because of an increased reaction rate. A solution temperature of 70° C. or less is preferred because of a low dissolution rate of the oxide layer.

The alkaline aqueous solution may be brought into contact with the oxide layer by any method, for example, a method of immersing the oxide layer in the alkaline aqueous solution, a method of spraying the oxide layer with the alkaline aqueous solution, or a method of applying the alkaline aqueous solution to the oxide layer with an application roll.

The alkaline aqueous solution is brought into contact with the oxide layer such that the amount of P ions deposited on the oxide layer is 1.8 $mg/m^2$ or more. In this case, the resulting galvanized steel sheet has good degreasing property. When the amount of deposited P ions is 1000 $mg/m^2$ or more, other qualities such as spot weldability may be affected. Thus, less than 1000 $mg/m^2$ is desirable.

The alkaline aqueous solution may be brought into contact with the oxide layer for 0.5 seconds or more. Contact for 0.5 seconds or more can impart good degreasing property to the galvanized steel sheet.

Examples of embodiments of the present invention will be described below with reference to Examples 1 to 3. The present invention is not limited to these examples.

EXAMPLES

Example 1

Cold-rolled steel sheets having a thickness of 0.7 mm subjected to hot-dipped galvanizing treatment and alloying treatment were subjected to skin pass rolling to produce galvannealed steel sheets. In a subsequent oxide layer forming treatment, the galvannealed steel sheets were immersed in an acidic solution prepared under the conditions listed in Table 1 (a table composed of Table 1-1 and Table 1-2 is referred to as Table 1), squeezed with rolls to form an acidic solution film, and held for a predetermined time listed in Table 1. The galvannealed steel sheets were then thoroughly washed with water and dried. A neutralization treatment was then performed under the conditions listed in Table 1.

The thickness of the surface oxide layer and the P content of each galvannealed steel sheet thus manufactured were measured. The press formability (sliding characteristics) and the degreasing property of each galvannealed steel sheet were also evaluated.

The press formability was evaluated in a repeated sliding test. The following describes a method for measuring the thickness of the oxide layer, a method for measuring the P content of the oxide layer, a method for evaluating the press formability (sliding characteristics) and a method for evaluating the degreasing property.

(1) Measurement of Thickness of Oxide Layer

The thickness of the oxide layer on the galvannealed steel sheet was measured with an X-ray fluorescence spectrometer. The tube voltage and tube current for measurement were 30 kV and 100 mA. The analyzing crystal was TAP. The O-K$\alpha$ line was detected. In the measurement of the O-K$\alpha$ line, in addition to the intensity at the peak position, the intensity at the background position was also measured to calculate the net intensity of the O-K$\alpha$ line. The integration times at the peak position and the background position were 20 seconds.

A series of the galvannealed steel sheets and a silicon wafer cleaved into an appropriate size on which silicon oxide films having thicknesses of 96, 54, and 24 nm were formed were placed on a sample stage. The intensity of the O-K$\alpha$ line could also be calculated from these silicon oxide films. A calibration curve of the thickness of the oxide layer versus the O-K$\alpha$ line intensity was prepared from these datum. The thickness of the oxide layer of each galvannealed steel sheet was calculated as the thickness of the oxide layer on a silicon oxide film basis.

(2) Measurement of P Content of Oxide Layer

The P content of the oxide layer was measured by ICP. The surface oxide layer was dissolved by immersion in ammonium dichromate+25% ammonium solution for 30 seconds. The amount of P ions dissolved in the solution was measured by ICP as the amount of deposit per unit area.

(3) Evaluation Method for Press Formability (Sliding Characteristics)

In order to evaluate the press formability, the friction coefficient of each sample was measured as described below.

FIG. 1 is a schematic front view of a friction coefficient measuring apparatus. As illustrated in the figure, a friction coefficient test sample 1 taken from each galvannealed steel sheet was fixed to a sample stage 2, which was fixed to the top surface of a horizontally movable slide table 3. The slide table 3 was disposed over a vertically movable slide table support 5, which included rollers 4 in contact with the slide table 3. The slide table support 5 was equipped with a first load cell 7, which was used to raise the slide table support 5 and measure the press load N of a bead 6 against the friction coefficient test sample 1. The slide table 3 was equipped with a second load cell 8 at one end thereof. The second load cell 8 was used to measure the sliding resistance force F for horizontally moving the slide table 3 under the press load. A press wash oil Preton R352L manufactured by Sugimura Chemical Industrial Co., Ltd. was applied to a surface of the friction coefficient test sample 1 as a lubricating oil before the test.

Figure 2:
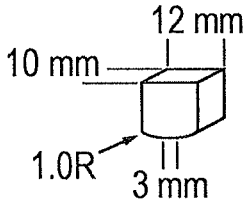
FIG. 2 is a schematic perspective view illustrating the shape and dimensions of a bead used under Condition 1 in EXAMPLES section.
Figure 3:
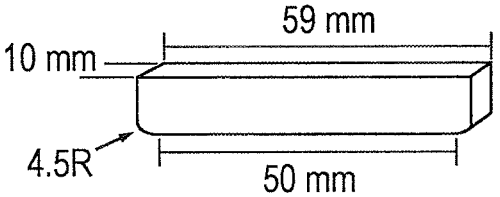
FIG. 3 is a schematic perspective view illustrating the shape and dimensions of a bead used under Condition 2 in EXAMPLES section.

FIGS. 2 and 3 are schematic perspective views illustrating the shape and dimensions of beads used in the test. The undersurface of the bead 6 was pressed against a surface of the friction coefficient test sample 1 while sliding. The bead 6 illustrated in FIG. 2 had a width of 10 mm and a length of 12 mm in the sample sliding direction. The lower ends of the bead 6 in the sliding direction had a curvature of 1 mmR. The undersurface of the bead 6 against which the friction coefficient test sample was pressed had a flat surface 10 mm in width and 3 mm in length in the sliding direction. The bead 6 illustrated in FIG. 3 had a width of 10 mm and a length of 59 mm in the sample sliding direction. The lower ends of the bead 6 in the sliding direction had a curvature of 4.5 mmR. The undersurface of the bead 6 against which the friction coefficient test sample was pressed had a flat surface 10 mm in width and 50 mm in length in the sliding direction.

A friction coefficient measurement test was performed under the following two conditions.

Condition 1

The bead illustrated in FIG. 2 was used. The press load N was 400 kgf, and the sample drawing speed (the horizontal travel speed of the slide table 3) was 100 cm/min.

Condition 2

The bead illustrated in FIG. 3 was used. The press load N was 400 kgf, and the sample drawing speed (the horizontal travel speed of the slide table 3) was 20 cm/min.

The friction coefficient $\mu$ between the friction coefficient test sample and the bead was calculated using the equation $\mu=F/N$.

(4) Evaluation Method for Degreasing Property

The degreasing property was evaluated as a water wetting rate after degreasing. A press wash oil Preton R352L manufactured by Sugimura Chemical Industrial Co., Ltd. was applied at 1.2 $g/m^2$ to one side of each galvannealed steel sheet. The galvannealed steel sheet was then subjected to degreasing treatment using an alkaline degreasing liquid FC-L4460 manufactured by Nihon Parkerizing Co., Ltd.

Degradation of the alkaline degreasing liquid in automobile production lines was simulated by adding 10 g/L of the press wash oil Preton R352L manufactured by Sugimura Chemical Industrial Co., Ltd. to the degreasing liquid in advance. The degreasing treatment time was 60 or 120 seconds, and the temperature was 37° C. During degreasing treatment, the degreasing liquid was stirred at 150 rpm with a propeller having a diameter of 10 cm. The degreasing property was evaluated by measuring the water wetting rate of the galvannealed steel sheet 20 seconds after the completion of the degreasing treatment.

Table 2 shows the results (a table composed of Table 2-1 and Table 2-2 is referred to as Table 2).

TABLE 1-1

| | Oxide layer forming treatment | | | | | | | |
|---|---|---|---|---|---|---|---|---|
| | Acidic solution | | | | | | Amount of | |
| | pH buffering agent | | pH adjusting agent | | Degree | Temper- | deposited acidic | Holding |
| No. | Type of chemical | Concentration (g/L) | Type of chemical | pH | solution film ($g/m^2$) | ature (° C.) | solution film ($g/m^2$) | time (s) |
| 1 | No treatment | — | — | — | — | — | — | — |
| 2 | Sodium | 30 | Sulfuric | 1.5 | 20 | 35 | 5 | 10 |
| 3 | acetate | | acid | | | | | 3 |
| 4 | trihydrate | | | | | | | 5 |
| 5 | | | | | | | | 10 |
| 6 | | | | | | | | 30 |
| 7 | | | | | | | | 60 |
| 8 | Sodium | 30 | Sulfuric | 1.5 | 20 | 35 | 5 | 3 |
| 9 | acetate | | acid | | | | | 5 |
| 10 | trihydrate | | | | | | | 10 |
| 11 | | | | | | | | 30 |
| 12 | | | | | | | | 60 |
| 13 | Sodium | 30 | Sulfuric | 0.8 | 20 | 35 | 5 | 10 |
| 14 | acetate | | acid | 1.0 | | | | |
| 15 | trihydrate | | | 1.2 | | | | |
| 16 | | | | 1.5 | | | | |
| 17 | | | | 2.0 | | | | |
| 18 | | | | 3.0 | | | | |
| 19 | Sodium | 0 | Sulfuric | 0.8 | 0.03 | 35 | 5 | 10 |
| 20 | acetate | 5 | acid | | 0.08 | | | |
| 21 | trihydrate | 20 | | | 0.16 | | | |
| 22 | | 50 | | | 0.48 | | | |
| 23 | Sodium | 30 | Sulfuric | 0.8 | 0.20 | 20 | 5 | 10 |
| 24 | acetate | | acid | | | 50 | | |
| 25 | trihydrate | | | | | 70 | | |
| 26 | Sodium | 30 | Sulfuric | 0.8 | 0.20 | 10 | 3 | 10 |
| 27 | acetate | | acid | | | | 5 | |
| 28 | trihydrate | | | | | | 10 | |
| 29 | | | | | | | 15 | |
| 30 | Sodium | 30 | Sulfuric | 0.8 | 0.20 | 10 | 5 | 10 |
| 31 | acetate | | acid | | | | | |
| 32 | trihydrate | | | | | | | |
| 33 | | | | | | | | |
| 34 | | | | | | | | |
| 35 | | | | | | | | |
| 36 | | | | | | | | |
| 37 | Sodium | 30 | Sulfuric | 0.8 | 0.20 | 10 | 5 | 10 |
| 38 | acetate | | acid | | | | | |
| 39 | trihydrate | | | | | | | |
| 40 | | | | | | | | |
| 41 | | | | | | | | |
| 42 | | | | | | | | |
| 43 | Sodium | 30 | Sulfuric | 0.8 | 0.20 | 10 | 5 | 10 |
| 44 | acetate | | acid | | | | | |
| 45 | trihydrate | | | | | | | |
| 46 | | | | | | | | |
| 47 | | | | | | | | |
| 48 | Sodium | 30 | Sulfuric | 0.8 | 0.20 | 10 | 5 | 10 |
| 49 | acetate | | acid | | | | | |
| 50 | trihydrate | | | | | | | |
| 51 | | | | | | | | |
| 52 | Sodium | 30 | Sulfuric | 0.8 | 0.20 | 10 | 5 | 10 |
| 53 | acetate | | acid | | | | | |
| 54 | trihydrate | | | | | | | |
| 55 | Sodium | 30 | Hydro- | 0.8 | 0.20 | 10 | 5 | 10 |
| 56 | acetate | | chloric | | | | | |
| | trihydrate | | acid | | | | | |
| | | | Nitric acid | | | | | |
| 57 | Potassium | 30 | Sulfuric | 0.8 | 0.42 | 10 | 5 | 10 |
| | phthalate | | acid | | | | | |

TABLE 1-1-continued

| | | | | | | | | | |
|---|---|---|---|---|---|---|---|---|---|
| 58 | Trisodium citrate dihydrate | | | | 0.34 | | | | |
| 59 | Disodium succinate hexahydrate | | | | 0.62 | | | | |
| 60 | Sodium lactate | | | | 0.41 | | | | |
| 61 | Sodium tartrate dihydrate | | | | 0.48 | | | | |
| 62 | Sodium borate decahydrate | | | | 0.53 | | | | |
| 63 | Trisodium phosphate 12 water | | | | 0.55 | | | | |
| 64 | Sodium | 30 | Sulfuric | 0.8 | 0.20 | 10 | 5 | | 10 |
| 65 | acetate | | acid | | | | | | |
| 66 | heptahydrate | | | | | | | | |
| 67 | Sodium | 30 | Sulfuric | 0.8 | 0.20 | 10 | 5 | | 10 |
| 68 | acetate | | acid | | | | | | |
| 69 | heptahydrate | | | | | | | | |
| 70 | | | | | | | | | |
| 71 | | | | | | | | | |
| 72 | | | | | | | | | |
| 73 | | | | | | | | | |

| | Neutralization treatment | | | | | | | | | |
|---|---|---|---|---|---|---|---|---|---|---|
| | Alkaline aqueous solution | | | | | | | | | |
| | Phosphorus compound | | Colloid dispersed particles | | | P ion | | | | Immersion |
| No. | Type of chemical | Concentration (g/L) | Type of chemical | Concentration (g/L) | Particle size (μm) | concentration (g/L) | pH | Stirring (rpm) | Temperature (° C.) | time (s) |
| 1 | No treatment | — | — | — | — | — | — | | — | |
| 2 | None | — | None | — | — | — | 6.7 | 150 | 50 | 3 |
| 3 | Sodium | 9.8 | None | — | — | 1.36 | 10.17 | 150 | 50 | 3 |
| 4 | pyrophosphate | | | | | | | | | |
| 5 | decahydrate | | | | | | | | | |
| 6 | | | | | | | | | | |
| 7 | | | | | | | | | | |
| 8 | Sodium | 9.8 | Ti colloid | 0.20 | 1 | 1.36 | 10.17 | 150 | 50 | 3 |
| 9 | pyrophosphate | | | | | | | | | |
| 10 | decahydrate | | | | | | | | | |
| 11 | | | | | | | | | | |
| 12 | | | | | | | | | | |
| 13 | Sodium | 9.8 | T icolloid | 0.20 | 1 | 1.36 | 10.17 | 150 | 50 | 3 |
| 14 | pyrophosphate | | | | | | | | | |
| 15 | decahydrate | | | | | | | | | |
| 16 | | | | | | | | | | |
| 17 | | | | | | | | | | |
| 18 | | | | | | | | | | |
| 19 | Sodium | 9.8 | Ti colloid | 0.20 | 1 | 1.36 | 10.17 | 150 | 50 | 3 |
| 20 | pyrophosphate | | | | | | | | | |
| 21 | decahydrate | | | | | | | | | |
| 22 | | | | | | | | | | |
| 23 | Sodium | 9.8 | Ticolloid | 0.20 | 1 | 1.36 | 10.17 | 150 | 50 | 3 |
| 24 | pyrophosphate | | | | | | | | | |
| 25 | decahydrate | | | | | | | | | |
| 26 | Sodium | 9.8 | Ti colloid | 0.20 | 1 | 1.36 | 10.17 | 150 | 50 | 3 |
| 27 | pyrophosphate | | | | | | | | | |
| 28 | decahydrate | | | | | | | | | |
| 29 | | | | | | | | | | |
| 30 | Sodium | 0.01 | Ti colloid | 0.20 | 1 | 0.00 | 9.21 | 150 | 50 | 3 |
| 31 | pyrophosphate | 0.1 | | | | 0.01 | 9.21 | | | |
| 32 | decahydrate | 0.5 | | | | 0.07 | 9.72 | | | |
| 33 | | 1.0 | | | | 0.14 | 9.85 | | | |
| 34 | | 20.0 | | | | 2.78 | 10.45 | | | |
| 35 | | 40.0 | | | | 5.56 | 10.86 | | | |
| 36 | | 100.0 | | | | 13.90 | 11.26 | | | |
| 37 | Sodium | 9.8 | Ti colloid | less | 1 | 1.36 | 10.17 | 150 | 50 | 3 |
| | pyrophosphate | | | than 0.01 | | | | | | |
| 38 | decahydrate | | | 0.01 | | | | | | |
| 39 | | | | 0.10 | | | | | | |
| 40 | | | | 1.00 | | | | | | |
| 41 | | | | 5.00 | | | | | | |
| 42 | | | | 10.00 | | | | | | |

TABLE 1-1-continued

| | | | | | | | | | | |
|---|---|---|---|---|---|---|---|---|---|---|
| 43 | Sodium pyrophosphate decahydrate | 9.8 | Ti colloid | 0.20 | less than 0.01 | 1.36 | 10.17 | 150 | 50 | 3 |
| 44 | | | | | 0.01 | | | | | |
| 45 | | | | | 0.1 | | | | | |
| 46 | | | | | 10 | | | | | |
| 47 | | | | | 100 | | | | | |
| 48 | Sodium pyrophosphate decahydrate | 9.8 | Ti colloid | 0.20 | 1 | 1.36 | 10.17 | 150 | 50 | 0.5 |
| 49 | | | | | | | | | | 1.5 |
| 50 | | | | | | | | | | 5 |
| 51 | | | | | | | | | | 10 |
| 52 | Sodium pyrophosphate decahydrate | 9.8 | Ti colloid | 0.20 | 1 | 1.36 | 10.17 | 150 | 20 | 3 |
| 53 | | | | | | | | | 30 | |
| 54 | | | | | | | | | 70 | |
| 55 | Sodium pyrophosphate decahydrate | 9.8 | Ti colloid | 0.20 | 1 | 1.36 | 10.17 | 150 | 50 | 3 |
| 56 | | | | | | | | | | |
| 57 | Sodium pyrophosphate decahydrate | 9.8 | Ti colloid | 0.20 | 1 | 1.36 | 10.17 | 150 | 50 | 3 |
| 58 | | | | | | | | | | |
| 59 | | | | | | | | | | |
| 60 | | | | | | | | | | |
| 61 | | | | | | | | | | |
| 62 | | | | | | | | | | |
| 63 | | | | | | | | | | |
| 64 | Sodium phosphate | 9.8 | Ti colloid | 0.20 | 1 | 1.36 | 10.17 | 150 | 50 | 3 |
| 65 | Sodium triphosphate | | | | | | | | | |
| 66 | Sodium pyrophosphate decahydrate | 9.8 | Colloidal silica | 0.20 | 1 | 1.36 | 10.17 | 150 | 50 | 3 |
| 67 | | | Pt colloid | | | | | | | |
| 68 | | | Pd colloid | | | | | | | |
| 69 | | | Zr colloid | | | | | | | |
| 70 | | | Ag colloid | | | | | | | |
| 71 | | | Cu colloid | | | | | | | |
| 72 | | | Au colloid | | | | | | | |
| 73 | | | Mg colloid | | | | | | | |

TABLE 2

| | Oxide layer analysis result | | | | Alkaline degreasing properties | |
|---|---|---|---|---|---|---|
| | Thickness | Amount of P | Press formability Friction coefficient | | Water wetting rate after | |
| No. | nm | mg/m$^2$ | Condition 1 | Condition 2 | degreasing 0% | Remarks |
| Table 2-1 | | | | | | |
| 1 | 8 | 0.0 | 0.175 | 0.235 | 100 | Comparative example |
| 2 | 31 | 0.0 | 0.129 | 0.165 | 60 | Comparative example |
| 3 | 18 | 1.1 | 0.141 | 0.189 | 60 | Comparative example |
| 4 | 25 | 1.2 | 0.139 | 0.178 | 60 | Comparative example |
| 5 | 31 | 1.1 | 0.129 | 0.165 | 60 | Comparative example |
| 6 | 46 | 1.3 | 0.120 | 0.152 | 60 | Comparative example |
| 7 | 63 | 1.2 | 0.119 | 0.143 | 60 | Comparative example |
| 8 | 18 | 3.0 | 0.139 | 0.192 | 100 | Example |
| 9 | 25 | 3.1 | 0.139 | 0.169 | 100 | Example |
| 10 | 31 | 3.3 | 0.128 | 0.163 | 100 | Example |
| 11 | 46 | 3.2 | 0.116 | 0.154 | 100 | Example |
| 12 | 63 | 3.1 | 0.119 | 0.147 | 100 | Example |
| 13 | 45 | 3.0 | 0.115 | 0.154 | 100 | Example |
| 14 | 42 | 3.2 | 0.115 | 0.152 | 100 | Example |
| 15 | 38 | 3.0 | 0.120 | 0.164 | 100 | Example |
| 16 | 31 | 3.3 | 0.120 | 0.163 | 100 | Example |
| 17 | 28 | 3.2 | 0.132 | 0.174 | 100 | Example |
| 18 | 27 | 3.2 | 0.134 | 0.176 | 100 | Example |
| 19 | 18 | 3.2 | 0.142 | 0.185 | 100 | Example |
| 20 | 25 | 3.1 | 0.134 | 0.180 | 100 | Example |
| 21 | 33 | 3.3 | 0.120 | 0.165 | 100 | Example |
| 22 | 28 | 3.2 | 0.129 | 0.170 | 100 | Example |
| 23 | 25 | 3.2 | 0.132 | 0.182 | 100 | Example |
| 24 | 31 | 3.1 | 0.120 | 0.165 | 100 | Example |
| 25 | 23 | 3.0 | 0.133 | 0.177 | 100 | Example |
| 26 | 28 | 3.2 | 0.130 | 0.168 | 100 | Example |
| 27 | 31 | 3.1 | 0.125 | 0.168 | 100 | Example |

TABLE 2-continued

| | Oxide layer analysis result | | | | Alkaline degreasing properties | |
|---|---|---|---|---|---|---|
| | Thickness | Amount of P | Press formability Friction coefficient | | Water wetting rate after | |
| No. | nm | mg/m$^2$ | Condition 1 | Condition 2 | degreasing 0% | Remarks |
| 28 | 33 | 3.3 | 0.127 | 0.167 | 100 | Example |
| 29 | 31 | 3.2 | 0.126 | 0.167 | 100 | Example |
| 30 | 31 | 1.1 | 0.128 | 0.168 | 60 | Comparative example |
| 31 | 31 | 1.8 | 0.128 | 0.168 | 100 | Example |
| 32 | 30 | 2.1 | 0.129 | 0.169 | 100 | Example |
| 33 | 32 | 2.5 | 0.125 | 0.164 | 100 | Example |
| 34 | 31 | 4.3 | 0.126 | 0.162 | 100 | Example |
| 35 | 30 | 6.8 | 0.125 | 0.160 | 100 | Example |
| 36 | 25 | 8.2 | 1.240 | 0.160 | 100 | Example |
| | | | Table 2-2 | | | |
| 37 | 30 | 1.2 | 0.124 | 0.162 | 50 | Comparative example |
| 38 | 30 | 1.8 | 0.124 | 0.162 | 100 | Example |
| 39 | 31 | 2.2 | 0.122 | 0.168 | 100 | Example |
| 40 | 32 | 3.4 | 0.125 | 0.165 | 100 | Example |
| 41 | 30 | 3.8 | 0.128 | 0.163 | 100 | Example |
| 42 | 30 | 4.2 | 0.128 | 0.163 | 100 | Example |
| 43 | 33 | 3.8 | 0.126 | 0.159 | 100 | Example |
| 44 | 33 | 3.6 | 0.126 | 0.159 | 100 | Example |
| 45 | 32 | 3.3 | 0.117 | 0.166 | 100 | Example |
| 46 | 30 | 2.8 | 0.128 | 0.164 | 100 | Example |
| 47 | 30 | 2.1 | 0.128 | 0.164 | 100 | Example |
| 48 | 32 | 1.9 | 0.123 | 0.167 | 100 | Example |
| 49 | 31 | 2.5 | 0.122 | 0.167 | 100 | Example |
| 50 | 33 | 3.8 | 0.121 | 0.165 | 100 | Example |
| 51 | 30 | 4.9 | 0.127 | 0.180 | 100 | Example |
| 52 | 33 | 2.5 | 0.122 | 0.164 | 100 | Example |
| 53 | 31 | 3.1 | 0.122 | 0.160 | 100 | Example |
| 54 | 28 | 4.1 | 0.123 | 0.178 | 100 | Example |
| 55 | 26 | 3.0 | 0.129 | 0.171 | 100 | Example |
| 56 | 25 | 3.0 | 0.131 | 0.173 | 100 | Example |
| 57 | 24 | 3.1 | 0.138 | 0.182 | 100 | Example |
| 58 | 23 | 3.2 | 0.136 | 0.189 | 100 | Example |
| 59 | 22 | 3.2 | 0.135 | 0.185 | 100 | Example |
| 60 | 26 | 3.2 | 0.137 | 0.181 | 100 | Example |
| 61 | 25 | 3.0 | 0.132 | 0.186 | 100 | Example |
| 62 | 24 | 3.3 | 0.139 | 0.187 | 100 | Example |
| 63 | 22 | 3.1 | 0.136 | 0.184 | 100 | Example |
| 64 | 32 | 3.1 | 0.125 | 0.170 | 100 | Example |
| 65 | 31 | 3.1 | 0.125 | 0.160 | 100 | Example |
| 66 | 30 | 2.8 | 0.126 | 0.160 | 100 | Example |
| 67 | 33 | 2.5 | 0.123 | 0.165 | 100 | Example |
| 68 | 32 | 2.6 | 0.123 | 0.160 | 100 | Example |
| 69 | 31 | 2.8 | 0.123 | 0.164 | 100 | Example |
| 70 | 30 | 2.2 | 0.128 | 0.168 | 100 | Example |
| 71 | 30 | 2.4 | 0.129 | 0.173 | 100 | Example |
| 72 | 32 | 2.3 | 0.124 | 0.172 | 100 | Example |
| 73 | 33 | 2.0 | 0.125 | 0.172 | 100 | Example |

Tables 1 and 2 show the followings. In Comparative Example steel sheet No. 1, which was not subjected to oxide layer forming treatment, the thickness of the oxide layer is 10 nm or less, and the press formability is poor. Steel sheets Nos. 2 to 7, No. 30, and No. 37, which were subjected to oxide layer forming treatment and neutralization treatment, are unsatisfactory (Comparative Examples) in which no colloid dispersed particles are added to an alkaline aqueous solution (Nos. 2 to 7), colloid dispersed particles are not sufficiently added (No. 37), or no P ions are added (No. 30). These steel sheets have good press formability but poor degreasing property. Steel sheets Nos. 8 to 73 are examples subjected to oxide layer forming treatment and neutralization treatment under appropriate conditions. These steel sheets have good press formability and degreasing property.

Example 2

Cold-rolled steel sheets having a thickness of 0.7 mm subjected to hot-dipped galvanizing treatment were subjected to skin pass rolling to produce hot-dipped galvanized steel sheets. The steel sheets were then subjected to activation treatment using an alkaline aqueous solution prepared under the conditions listed in Table 3. The steel sheets were subjected to oxide layer forming treatment by immersing the steel sheets in an acidic solution prepared under the conditions listed in Table 3, squeezing the steel sheets with rolls to form an acidic solution film, and holding the steel sheets for a predetermined time listed in Table 3. The steel sheets were then thoroughly washed with water and dried. A neutralization treatment was then performed under the conditions listed in Table 3.

The thickness of the surface oxide layer and the P content of each hot-dipped galvanized steel sheet thus manufactured were measured. The press formability (sliding characteristics) and the degreasing property of each hot-dipped galvanized steel sheet were also evaluated in the same manner as in Example 1.

Table 4 shows the results.

TABLE 3

| | Activation treatment | | | | | Oxide layer forming treatment | | | | | |
|---|---|---|---|---|---|---|---|---|---|---|---|
| | Alkaline aqueous solution | | | | | Acidic solution | | | | | |
| | | | | | | pH buffering agent | | pH adjusting agent | | | |
| No. | Type of chemical | Concentration (g/L) | Type of chemical | pH | Immersion time (sec) | Type of chemical | Concentration (g/L) | Type of chemical | pH | Degree of pH increase | Temperature (° C.) |
| 1 | — | — | — | — | — | No treatment | — | — | — | — | — |
| 2 | — | — | — | — | — | Sodium acetate trihydrate | 30 | Sulfuric acid | 1.5 | 0.20 | 35 |
| 3 | | | | | | | | | | | |
| 4 | | | | | | | | | | | |
| 5 | | | | | | | | | | | |
| 6 | | | | | | | | | | | |
| 7 | | | | | | | | | | | |
| 8 | — | — | — | — | — | Sodium acetate trihydrate | 30 | Sulfuric acid | 1.5 | 0.20 | 35 |
| 9 | | | | | | | | | | | |
| 10 | | | | | | | | | | | |
| 11 | | | | | | | | | | | |
| 12 | | | | | | | | | | | |
| 13 | NaOH | 0.1 | 50 | 10.0 | 5 | Sodium acetate trihydrate | 30 | Sulfuric acid | 1.5 | 0.20 | 35 |
| 14 | | 1 | | 12.0 | | | | | | | |
| 15 | | 5 | | 12.5 | | | | | | | |
| 16 | | 10 | | 13.0 | | | | | | | |
| 17 | | 100 | | 14.0 | | | | | | | |
| 18 | NaOH | 5 | 20 | 12.5 | 5 | Sodium acetate trihydrate | 30 | Sulfuric acid | 1.5 | 0.20 | 35 |
| 18 | | | 30 | | | | | | | | |
| 20 | | | 40 | | | | | | | | |
| 21 | | | 60 | | | | | | | | |
| 22 | | | 70 | | | | | | | | |

| | | | Neutralization treatment | | | | | | | | | |
|---|---|---|---|---|---|---|---|---|---|---|---|---|
| | | | Alkaline aqueous solution | | | | | | | | | |
| | | | Phosphorus compound | | Colloid dispersed particles | | | P ion | | | | |
| No. | Amount of deposited acidic solution film ($g/m^2$) | Holding time (s) | Type of chemical | Concentration (g/L) | Type of chemical | Concentration (g/L) | Particle size (μm) | concentration (g/L) | pH | Stirring (rpm) | Temperature (° C.) | Immersion time (s) |
| 1 | — | — | No treatment | — | — | — | — | — | — | — | — | — |
| 2 | 5 | 10 | None | — | None | — | — | — | 6.7 | 150 | 50 | 3 |
| 3 | | 3 | Sodium pyrophosphate decahydrate | 9.8 | None | — | — | 1.36 | 10.17 | 150 | 50 | 3 |
| 4 | | 5 | | | | | | | | | | |
| 5 | | 10 | | | | | | | | | | |
| 6 | | 30 | | | | | | | | | | |
| 7 | | 60 | | | | | | | | | | |
| 8 | 5 | 3 | Sodium pyrophosphate decahydrate | 9.8 | Ti colloid | 0.20 | 1 | 1.36 | 10.17 | 150 | 50 | 3 |
| 9 | | 5 | | | | | | | | | | |
| 10 | | 10 | | | | | | | | | | |
| 11 | | 30 | | | | | | | | | | |
| 12 | | 60 | | | | | | | | | | |
| 13 | 5 | 10 | Sodium pyrophosphate decahydrate | 9.8 | Ti colloid | 0.20 | 1 | 1.36 | 10.17 | 150 | 50 | 3 |
| 14 | | 10 | | | | | | | | | | |
| 15 | | 10 | | | | | | | | | | |
| 16 | | 10 | | | | | | | | | | |
| 17 | | 10 | | | | | | | | | | |
| 18 | 5 | 10 | Sodium pyrophosphate decahydrate | 9.8 | Ti colloid | 0.20 | 1 | 1.36 | 10.17 | 150 | 50 | 3 |
| 18 | | 10 | | | | | | | | | | |
| 20 | | 10 | | | | | | | | | | |
| 21 | | 10 | | | | | | | | | | |
| 22 | | 10 | | | | | | | | | | |

TABLE 4

| Oxide layer analysis result | | | | | Alkaline degreasing properties | |
|---|---|---|---|---|---|---|
| | Thickness | Amount of P | Press formability Friction coefficient | | Water wetting rate after | |
| No. | nm | mg/m$^2$ | Condition 1 | Condition 2 | degreasing % | Remarks |
| 1 | 8 | 0.0 | 0.146 | 0.296 | 100 | Comparative example |
| 2 | 28 | 0.0 | 0.099 | 0.189 | 60 | Comparative example |
| 3 | 15 | 0.9 | 0.112 | 0.202 | 60 | Comparative example |
| 4 | 21 | 1.3 | 0.109 | 0.198 | 60 | Comparative example |
| 5 | 29 | 1.1 | 0.099 | 0.186 | 60 | Comparative example |
| 6 | 41 | 1.2 | 0.093 | 0.175 | 60 | Comparative example |
| 7 | 49 | 1.1 | 0.091 | 0.163 | 60 | Comparative example |
| 8 | 16 | 3.0 | 0.111 | 0.199 | 100 | Example |
| 9 | 19 | 3.1 | 0.108 | 0.196 | 100 | Example |
| 10 | 28 | 3.3 | 0.096 | 0.183 | 100 | Example |
| 11 | 42 | 3.2 | 0.094 | 0.176 | 100 | Example |
| 12 | 51 | 3.1 | 0.090 | 0.163 | 100 | Example |
| 13 | 32 | 3.0 | 0.086 | 0.193 | 100 | Example |
| 14 | 45 | 3.2 | 0.080 | 0.190 | 100 | Example |
| 15 | 63 | 3.1 | 0.075 | 0.156 | 100 | Example |
| 16 | 62 | 2.9 | 0.073 | 0.153 | 100 | Example |
| 17 | 65 | 3.5 | 0.076 | 0.158 | 100 | Example |
| 18 | 45 | 3.1 | 0.086 | 0.175 | 100 | Example |
| 19 | 59 | 3.6 | 0.079 | 0.155 | 100 | Example |
| 20 | 61 | 3.4 | 0.077 | 0.154 | 100 | Example |
| 21 | 62 | 3.3 | 0.078 | 0.159 | 100 | Example |
| 22 | 64 | 3.2 | 0.073 | 0.152 | 100 | Example |

Tables 3 and 4 show the followings. In Comparative Example steel sheet No. 1 not subjected to oxide layer forming treatment, the thickness of the oxide layer is 10 nm or less, and the press formability is poor. Steel sheets Nos. 2 to 7 subjected to oxide layer forming treatment and neutralization treatment are unsatisfactory (Comparative Examples) in which no colloid dispersed particles or P ions are added to an alkaline aqueous solution. These steel sheets have good press formability but poor degreasing property. Steel sheets Nos. 8 to 12 are examples subjected to oxide layer forming treatment and neutralization treatment under appropriate conditions. These steel sheets have good press formability and degreasing property. Steel sheets Nos. 13 to 22 are examples subjected to activation treatment, oxide layer forming treatment and neutralization treatment under appropriate conditions. These steel sheets have good press formability and degreasing property.

Example 3

Cold-rolled steel sheets having a thickness of 0.7 mm was subjected to electrogalvanizing treatment. The steel sheets were then subjected to activation treatment using an alkaline aqueous solution prepared under the conditions listed in Table 5. The steel sheets were subjected to oxide layer forming treatment by immersing the steel sheets in an acidic solution prepared under the conditions listed in Table 5, squeezing the steel sheets with rolls to form an acidic solution film, and holding the steel sheets for a predetermined time listed in Table 5. The steel sheets were then thoroughly washed with water and dried. A neutralization treatment was then performed under the conditions listed in Table 5.

The thickness of the surface oxide layer and the P content of each electrogalvanized steel sheet thus manufactured were measured. The press formability (sliding characteristics) and degreasing property of each electrogalvanized steel sheet were also evaluated in the same manner as in Example 1. Table 6 shows the results.

TABLE 5

| Activation treatment | | | | | | Oxide layer forming treatment | | | | | | | |
|---|---|---|---|---|---|---|---|---|---|---|---|---|---|
| Alkaline aqueous solution | | | | | | Acidic solution | | | | | | Amount of deposited acidic solution film | |
| | | | | | Immersion time | pH buffering agent | | pH adjusting agent | | | | | |
| No. | Type of chemical | Concentration (g/L) | Temperature (° C.) | pH | (sec) | Type of chemical | Concentration (g/L) | Type of chemical | pH | Degree of pH increase | Temperature (° C.) | (g/m$^2$) | Holding time (s) |
| 1 | — | — | — | — | — | No treatment | — | — | — | — | — | — | — |
| 2 | — | — | — | — | — | Sodium acetate trihydrate | 30 | Sulfuric acid | 1.5 | 0.20 | 35 | 5 | 10 |
| 3 | | | | | | | | | | | | | 3 |
| 4 | | | | | | | | | | | | | 5 |
| 5 | | | | | | | | | | | | | 10 |

TABLE 5-continued

| | | | | | | | | | | | | | |
|---|---|---|---|---|---|---|---|---|---|---|---|---|---|
| 6 | | | | | | | | | | | | | 30 |
| 7 | | | | | | | | | | | | | 60 |
| 8 | — | — | — | — | — | Sodium | 30 | Sulfuric | 1.5 | 0.20 | 35 | 5 | 3 |
| 9 | | | | | | acetate | | acid | | | | | 5 |
| 10 | | | | | | trihydrate | | | | | | | 10 |
| 11 | | | | | | | | | | | | | 30 |
| 12 | | | | | | | | | | | | | 60 |
| 13 | NaOH | 0.1 | 50 | 10.0 | 5 | Sodium | 30 | Sulfuric | 1.5 | 0.20 | 35 | 5 | 10 |
| 14 | | 1 | | 12.0 | | acetate | | acid | | | | | 10 |
| 15 | | 5 | | 12.5 | | trihydrate | | | | | | | 10 |
| 16 | | 10 | | 13.0 | | | | | | | | | 10 |
| 17 | | 100 | | 14.0 | | | | | | | | | 10 |
| 18 | NaOH | 5 | 20 | 12.5 | 5 | Sodium | 30 | Sulfuric | 1.5 | 0.20 | 35 | 5 | 10 |
| 19 | | | 30 | | | acetate | | acid | | | | | 10 |
| 20 | | | 40 | | | trihydrate | | | | | | | 10 |
| 21 | | | 60 | | | | | | | | | | 10 |
| 22 | | | 70 | | | | | | | | | | 10 |

| | | Neutralization treatment | | | | | | | | | | |
|---|---|---|---|---|---|---|---|---|---|---|---|---|
| | | Alkaline aqueous solution | | | | | | | | | | |
| | | Phosphorus compound | | Colloid dispersed particles | | | | | | | | Immer- |
| | No. | Type of chemical | Concen-tration (g/L) | Type of chemical | Concen-tration (g/L) | Particle size (μm) | P ion concentration (g/L) | pH | Stirring (rpm) | Temper-ature (° C.) | sion time (s) |
| | 1 | No treatment | — | — | — | — | — | — | — | — | — |
| | 2 | None | — | None | — | — | — | 6.7 | 150 | 50 | 3 |
| | 3 | Sodium pyrophosphate decahydrate | 9.8 | None | — | — | 1.36 | 10.17 | 150 | 50 | 3 |
| | 4 | | | | | | | | | | |
| | 5 | | | | | | | | | | |
| | 6 | | | | | | | | | | |
| | 7 | | | | | | | | | | |
| | 8 | Sodium pyrophosphate decahydrate | 9.8 | Ti colloid | 0.20 | 1 | 1.36 | 10.17 | 150 | 50 | 3 |
| | 9 | | | | | | | | | | |
| | 10 | | | | | | | | | | |
| | 11 | | | | | | | | | | |
| | 12 | | | | | | | | | | |
| | 13 | Sodium pyrophosphate decahydrate | 9.8 | Ti colloid | 0.20 | 1 | 1.36 | 10.17 | 150 | 50 | 3 |
| | 14 | | | | | | | | | | |
| | 15 | | | | | | | | | | |
| | 16 | | | | | | | | | | |
| | 17 | | | | | | | | | | |
| | 18 | Sodium pyrophosphate decahydrate | 9.8 | Ti colloid | 0.20 | 1 | 1.36 | 10.17 | 150 | 50 | 3 |
| | 19 | | | | | | | | | | |
| | 20 | | | | | | | | | | |
| | 21 | | | | | | | | | | |
| | 22 | | | | | | | | | | |

TABLE 6

| | Oxide layer analysis result | | | | Alkaline degreasing properties | |
|---|---|---|---|---|---|---|
| | Thickness | Amount of P | Press formability Friction coefficient | | Water wetting rate after degreasing | |
| No. | nm | mg/m$^2$ | Condition 1 | Condition 2 | % | Remarks |
| 1 | 5 | 0.0 | 0.172 | 0.305 | 100 | Comparative example |
| 2 | 26 | 0.0 | 0.096 | 0.189 | 60 | Comparative example |
| 3 | 14 | 1.0 | 0.113 | 0.214 | 60 | Comparative example |
| 4 | 19 | 1.2 | 0.108 | 0.206 | 60 | Comparative example |
| 5 | 27 | 1.3 | 0.096 | 0.189 | 60 | Comparative example |
| 6 | 36 | 0.9 | 0.093 | 0.180 | 60 | Comparative example |
| 7 | 45 | 1.0 | 0.092 | 0.175 | 60 | Comparative example |
| 8 | 13 | 3.3 | 0.113 | 0.210 | 100 | Example |
| 9 | 18 | 3.2 | 0.105 | 0.205 | 100 | Example |
| 10 | 22 | 3.5 | 0.098 | 0.199 | 100 | Example |
| 11 | 40 | 3.4 | 0.096 | 0.185 | 100 | Example |
| 12 | 50 | 3.1 | 0.080 | 0.176 | 100 | Example |
| 13 | 26 | 3.2 | 0.096 | 0.190 | 100 | Example |
| 14 | 46 | 3.0 | 0.086 | 0.186 | 100 | Example |

TABLE 6-continued

| | Oxide layer analysis result | | | | Alkaline degreasing properties | |
|---|---|---|---|---|---|---|
| | Thickness | Amount of P | Press formability Friction coefficient | | Water wetting rate after degreasing | |
| No. | nm | mg/m$^2$ | Condition 1 | Condition 2 | % | Remarks |
| 15 | 62 | 2.9 | 0.075 | 0.156 | 100 | Example |
| 16 | 64 | 2.8 | 0.074 | 0.157 | 100 | Example |
| 17 | 63 | 3.5 | 0.073 | 0.160 | 100 | Example |
| 18 | 40 | 3.5 | 0.076 | 0.169 | 100 | Example |
| 19 | 58 | 3.2 | 0.070 | 0.160 | 100 | Example |
| 20 | 62 | 3.2 | 0.075 | 0.150 | 100 | Example |
| 21 | 61 | 3.4 | 0.076 | 0.153 | 100 | Example |
| 22 | 64 | 3.2 | 0.073 | 0.156 | 100 | Example |

Tables 5 and 6 show the followings. In Comparative Example steel sheet No. 1 not subjected to galvanization, the thickness of the oxide layer is 10 nm or less, and the press formability is poor. Steel sheets Nos. 2 to 7 subjected to oxide layer forming treatment and neutralization treatment are unsatisfactory (Comparative Examples) in which no colloid dispersed particles or no P ions are added to an alkaline aqueous solution. These steel sheets have good press formability but poor degreasing property. Steel sheets Nos. 8 to 12 are examples subjected to oxide layer forming treatment and neutralization treatment under appropriate conditions. These steel sheets have good press formability and degreasing property. Steel sheets Nos. 13 to 22 are examples subjected to activation treatment, oxide layer forming treatment and neutralization treatment under appropriate conditions. These steel sheets have good press formability and degreasing property.

REFERENCE SIGNS LIST

1 Friction coefficient test sample
2 Sample stage
3 Slide table
4 Roller
5 Slide table support
6 Bead
7 First load cell
8 Second load cell
9 Rail
N Press load
F Sliding resistance force

The invention claimed is:

1. A method for manufacturing a galvanized steel sheet that includes an oxide layer on the surface thereof, comprising:

an oxide layer forming step of bringing a galvanized steel sheet into contact with an acidic solution for 1 to 60 seconds, and then washing the galvanized steel sheet with water; and a neutralization treatment step of bringing a surface of an oxide layer, formed in the oxide layer forming step, into contact with an alkaline aqueous solution for 0.5 seconds or more, washing the surface of the oxide layer with water, and drying the surface of the oxide layer;

wherein the alkaline aqueous solution contains 0.01 g/L or more of P ions and 0.01 g/L or more of colloid dispersed particles.

2. The method for manufacturing a galvanized steel sheet according to claim 1, wherein the alkaline aqueous solution contains at least one phosphorus compound selected from phosphates, pyrophosphates, and triphosphates and at least one type of colloid dispersed particles selected from Ti, silica, Pt, Pd, Zr, Ag, Cu, Au, and Mg.

3. The method for manufacturing a galvanized steel sheet according to claim 1, wherein the alkaline aqueous solution has a pH in the range of 9 to 12 and a temperature in the range of 20° C. to 70° C.

4. The method for manufacturing a galvanized steel sheet according to claim 1, wherein the acidic solution has a pH buffering action and a degree of pH increase in the range of 0.003 to 0.5, the degree of pH increase being the amount (L) of 1.0 mol/L sodium hydroxide solution required to increase a pH of 1'L of the acidic solution to 2.0 to 5.0.

5. The method for manufacturing a galvanized steel sheet according to claim 1, wherein the acidic solution contains 5 to 50 g/L in total of at least one salt selected from acetates, phthalates, citrates, succinates, lactates, tartrates, borates, and phosphates, has a pH in the range of 0.5 to 5.0, and a temperature in the range of 20° C. to 70° C.

6. The method for manufacturing a galvanized steel sheet according to claim 1, wherein the amount of acidic solution deposited on the surface of the galvanized steel sheet after contact with the acidic solution in the oxide layer forming step is 15 g/m$^2$ or less.

7. The method for manufacturing a galvanized steel sheet according to claim 1, wherein the galvanized steel sheet is a galvannealed steel sheet.

8. The method for manufacturing a galvanized steel sheet according to claim 1, wherein the galvanized steel sheet is a hot-dipped galvanized steel sheet.

9. The method for manufacturing a galvanized steel sheet according to claim 1, wherein the galvanized steel sheet is an electrogalvanized steel sheet.

10. The method for manufacturing a galvanized steel sheet according to claim 1, wherein the galvanized steel sheet is subjected to skin pass rolling before the oxide layer forming step.

11. The method for manufacturing a galvanized steel sheet according to claim 1, wherein the galvanized steel sheet is brought into contact with an alkaline aqueous solution to activate the surface thereof before the oxide layer forming step.

* * * * *